United States Patent [19]

Mallott, Sr.

[11] 4,275,621

[45] Jun. 30, 1981

[54] IMPLEMENT FOR ATTACHING HANGERS

[76] Inventor: Louis J. Mallott, Sr., P.O. Box 64, Linden, Pa. 17744

[21] Appl. No.: 82,306

[22] Filed: Oct. 5, 1979

[51] Int. Cl.[3] ..... B25B 13/28

[52] U.S. Cl. ..... 81/111; 81/121 A

[58] Field of Search ..... 81/90 D, 111, 121 A; 145/50 R, 50 DB

[56] References Cited

U.S. PATENT DOCUMENTS

| | | | |
|---|---|---|---|
| 670,361 | 3/1901 | Sather | 145/50 DB |
| 798,703 | 9/1905 | Reynolds | 145/50 DB |
| 841,472 | 1/1907 | Vanderherchen | 145/50 DB |
| 882,937 | 3/1908 | Fegley | 145/50 DB UX |
| 1,420,701 | 6/1922 | Hoffman | 81/121 A |

*Primary Examiner*—James G. Smith
*Attorney, Agent, or Firm*—Francis A. Keegan

[57] ABSTRACT

An implement for attaching hangers such as screw eyes, screw hooks and the like to surfaces particularly ceilings and walls in which the hanger is held in the body of the implement with the screw end directed outwardly. The hanger is secured by a pivoted cover which releases the hanger from the body upon a contact activator positioned on the implement contacting the ceiling or wall. Upon such contact the cover is opened and the continued rotation of the implement immediately frees the hanger from the implement without further action by the operator.

11 Claims, 3 Drawing Figures

FIG. 1.
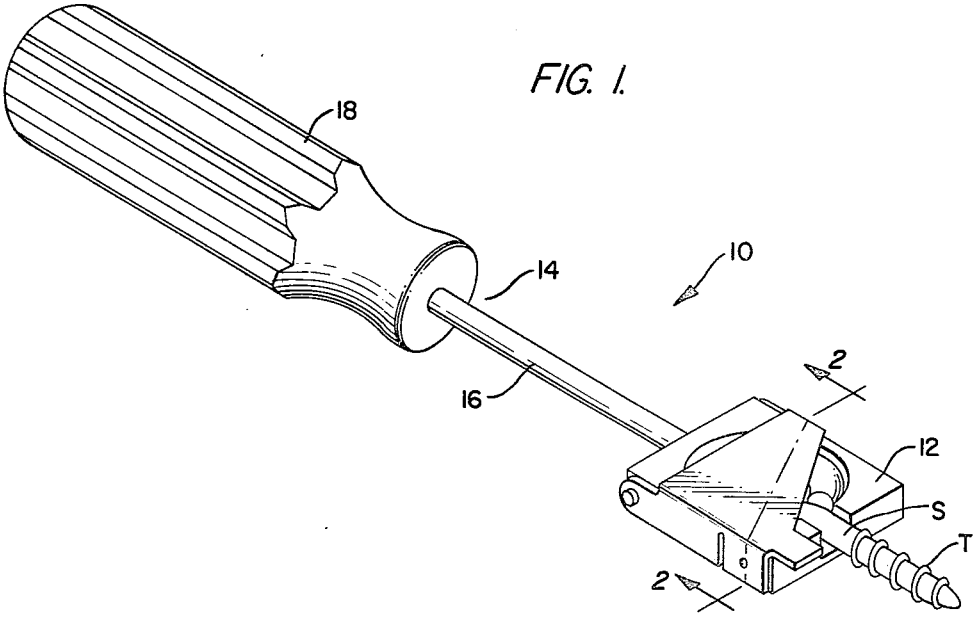
FIG. 2.
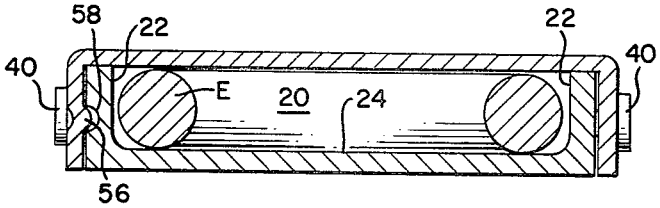
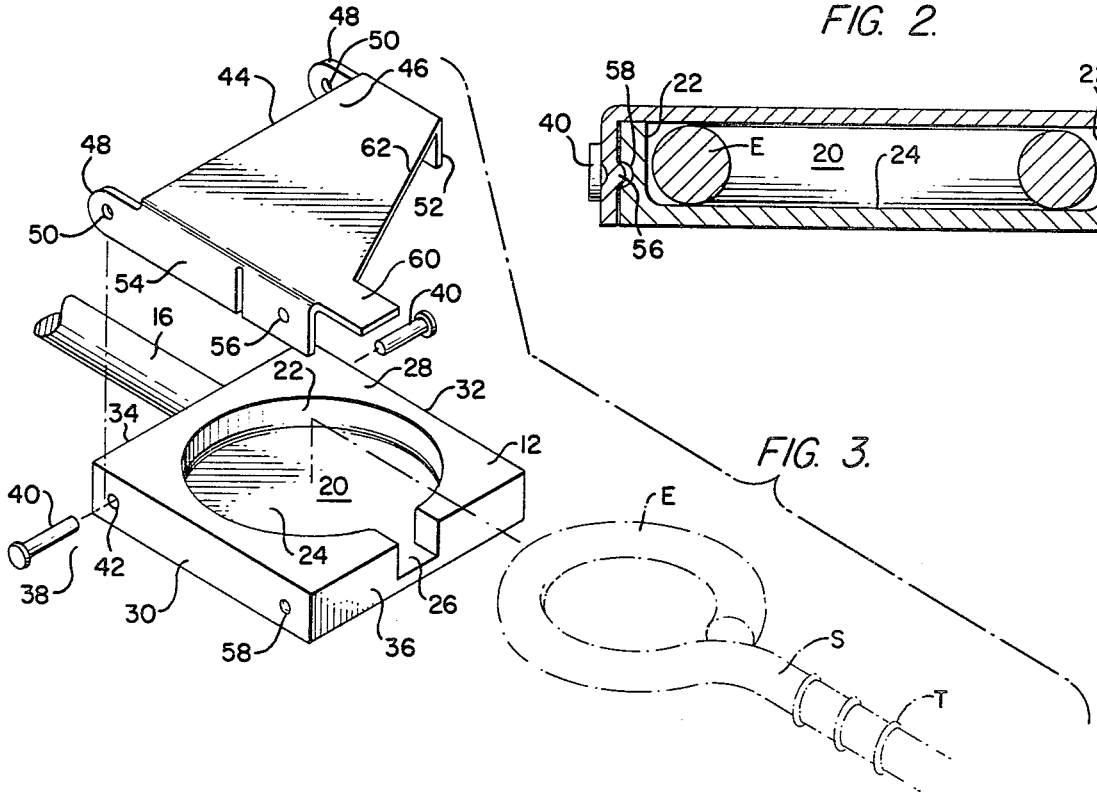
FIG. 3.

IMPLEMENT FOR ATTACHING HANGERS

BACKGROUND OF THE INVENTION

1. Field of the Invention

This invention relates generally to implements for attaching hangers such as screw eyes and screw hooks and the like to various surfaces. More particularly this invention relates to an implement for attaching a hanger having a screw end into a surface such as a ceiling.

2. Description of Prior Art

The patent to Reynolds 798,703 discloses a tool for attaching screw eyes into ceilings for use as hangers. A ceiling striker is included in the implement for the purpose of striking a ceiling to release the screw eye from a vise jaw used to clamp the screw eye into position in the implement. While the vise jaw releases the screw eye the tool must still be withdrawn from the screw eye to the extent that the implement holding slot clears the end of the screw eye.

Rudolph U.S. Pat. No. 1,504,148 discloses a mechanism for the automatic release of a screw eye through the use of stops to prevent the tool from continuing its forward motion following the screw eye.

Sather U.S. Pat. No. 670,361 relates to a machine for driving screw eyes but fails to disclose any automatic release feature.

OBJECTS OF THE INVENTION

It is the principal object of the present invention to provide an implement for attaching hangers such as screw eyes, screw hooks and the like to surfaces such as walls and ceilings and automatically disengage the implement from the hanger upon preselected contact of the implement with the surface.

This invention also has an object the provision of an implement for attaching hangers having a screw end which may be operated easily by means of the automatic disengagement feature upon the hanger being properly positioned in the surface.

This invention also has as a further and more general object the provision of an implement for inserting hangers such as screw eyes and the like into ceilings or walls and in which the implement is economical to manufacture and does not require a skilled operator to use.

SUMMARY OF THE INVENTION

An implement for attaching hangers of the type such as screw eyes, screw hooks and the like into surfaces such as ceilings and walls which is provided with the body having a receiving slot for holding a hanger having a screw end. The receiving slot is aided in retaining the hanger in position by a pivotally secured cover secured at one end of the body to releasably secure the hanger in the receiving slot. A securing means such as a detent positioned on one side wall of the cover coacts with the body to retain the cover in position to secure the hanger within the receiving slot in the body. A contact activator which may be positioned on the implement and formed as a tab extension on the cover is designed for selected contact with the surface into which the hanger is to be screwed. When such contact is achieved the securing means is released, the cover pivotally opens and the hanger is automatically and instantly disengaged from the implement without any further action by the operator.

DESCRIPTION OF THE DRAWINGS

FIG. 1 is a perspective view of the implement of the present invention illustrating the handle in the form of a screw driver and the screw eye hanger in position and adapted to be screwed into a selected surface.

FIG. 2 is a cross-sectional view taken along lines 2—2 of FIG. 1 and illustrating the positioning of the screw eye within the receiving slot and also the releasable securing means in the form of the detent.

FIG. 3 is an exploded view partly broken away showing in phantom lines the screw eye and the construction of the cover, the pivotal mounting and the receiving slot.

DESCRIPTION OF THE PREFERRED EMBODIMENT

The implement of the present invention for attaching conventional screw hangers is illustrated in the perspective view in FIG. 1 and identified by the numeral 10. A conventional hanger such as the screw eye is shown in FIGS. 1 and 3 with an eye E, shank S and screw threads T.

The implement includes a body 12 and a handle means 14 that may include a shaft 16 and a screw driver like handle 18. The handle means 14 should be considered in its broadest sense such that a shaft 16 as shown in FIG. 3 may not have attached the screw driver like handle 18 but may be shaped as shown in FIG. 3 for insertion into a conventional electric drill (not shown). The manner of operation of the implement to provide the necessary rotation to drive the screw threads T is optional and can be manually powered as shown in FIG. 1 or, as proposed in the alternative, may be an electric drill.

The body 12 as best shown in FIGS. 2 and 3 may be in the form of a block of any suitable material such as metal or plastic and the like having a receiving slot 20 that may be disc shaped with rounded vertical sides 22 and a back or bottom surface 24. The slot 20 is provided with a cutaway groove 26 extending to the bottom surface to accommodate the shank S of the screw eye.

The body 12 is provided with an upper surface 28 essentially parallel to the back surface 20 of the receiving slot and may have vertical opposing sides 30 and 32 and a pair of opposing sides 34 and 36. The shaft 16 is secured to the body through side 34 in any conventional manner such as welding (not shown) and the cutaway groove 26 extends from the receiving slot into and cuts away from the body side 36.

The shape of the receiving slot is shown to be round to accommodate the shape of the eye E however it should be understood that the shape of the receiving slot need not be as shown but rather simply sufficient to accommodate and hold any hanger such as may be inserted into the slot. Hangers, for instance, may be in the form of hooks either "J", "L" or "T" shaped. It is contemplated to be within the scope of this invention to have the receiving slot specifically designed for any shape of hanger or formed in the preferred general shape as shown which would accommodate essentially any one of the hangers mentioned.

Secured to the body at one end is a pivot means 38 which may be in the form of pins or could be a single rod extending through suitable bore 42. It is also contemplated to be within the scope of this invention to have enlargements in the form of journals positioned in the position of the bore 42 to act in the same manner as the pivot pins 40. The pivot means 38 is designed to permit pivotal movement of a cover 44.

The cover 44 forms an important part of the present invention in that it provides a means for securely holding the hanger in the receiving slot and it is operative to automatically permit the disengagement of the screw eye from the implement as will be shown.

The cover 44 is shown in the form of a metal plate having a planar top surface 46 and extending ears 48 at each end provided with suitable bores 50 to receive the pivot means 38 and permit pivotal movement of the cover 44. It is also desirable, though not essential, that the positioning of the pivot means 38 is removed from the center of the receiving slot 20 so that the cover and pivot can be completely clear of the receiving slot. The cover 44 is provided with down turned sides 52 and 54 to aid in stabilizing the positioning of the cover and also to provide a securing means releasable at a predetermined time to permit the cover to open for disengagement of the screw eye from the implement.

The securing means on the cover is in the form of a detent 56 formed on the inside of the side 54 of the cover as best shown in FIG. 2. The detent 56 cooperates with a dimple or other depression 58 in the side 30 of body 12. The structural design of the down turned sides and the combination of the detent 56 and dimple 58 is to hold the cover in position until a force is applied adequate to dislodge the detent.

The implement 10 is provided with a contact activator that as shown is provided as a tab extension 60 extending upwardly from the downwardly inclined surface 62 of the cover. The tab 60 is designed to extend above and beyond the body 12 and particularly cover surface 36. In fact the tab 60 extends beyond the implement 10 to provide in effect the leading end for contact with the wall or ceiling after the screw eye has been rotated into position sufficiently to enable contact between the tab 60 and the ceiling or wall to occur. At the time such contact occurs and provided that there is further forward rotation of the implement, the force on the tab 60 will overcome the holding capability of the detent 56 in dimple 58 and the cover 44 will pivot on the pivot 38 to uncover the screw eye held in the receiving slot 20. In such moment simply by reason of the torque applied for rotation, the screw eye will be automatically disengaged from the implement without any further action necessary to be taken by the operator.

It is believed that all of the foregoing objects have been achieved by the description of the invention and therefore the scope of the invention should be limited solely by the scope of the appended claims.

I claim:

1. An implement for attaching hangers of the type such as screw eyes, screw hooks and the like to surfaces comprising:

a body for holding the hanger having a screw end for penetration into the surface, handle means attached to said body for rotation of said body and penetration of said screw end into said surface, a cover pivotally secured at one end to said body to releasably secure said hanger within said body, securing means releasably acting between said cover and said body to retain said cover in position to secure said hanger within said body, a contact activator positioned on said implement operably connected to said securing means to release and pivot said cover away from said securing means upon said contact activator contacting said surface whereby said hanger is disengaged from said implement.

2. The implement of claim 1 including, a receiving slot formed in said body and shaped to conform in part to said hanger.

3. The implement of claim 2 including, said receiving slot, a back and an open front.

4. The implement of claim 2 including, said cover being superposed over said slot and pivoted to open and close said slot.

5. The implement of claim 1 including, said securing means being a detent means.

6. The implement of claim 5 including, said detent means being positioned on said cover at an end of said cover remote relative to said pivotally secured end.

7. The implement of claim 1, 2, 3, 4, 5 or 6 including, said contact activator being positioned on said cover and extending outwardly from said body in the direction of said hanger screw end for contact with said surface.

8. The implement of claim 7 including, said contact activator being a tab extension of said cover.

9. The implement of claim 1 including, said cover having at least one side extending down or along side of said body to guide the movement of said cover.

10. The implement of claim 9 including, said cover and said body being pivoted to each other at said one end.

11. The implement of claim 5 or 9 including, said cover side being provided with said securing means.

* * * * *